US010358891B2

(12) United States Patent
Knott

(10) Patent No.: US 10,358,891 B2
(45) Date of Patent: Jul. 23, 2019

(54) PORTABLE LUBRICATION UNIT FOR A HYDRAULIC FRACTURING VALVE ASSEMBLY, AND METHOD FOR PRE-PRESSURIZING VALVES

(71) Applicant: Christopher M. Knott, Midland, TX (US)

(72) Inventor: Christopher M. Knott, Midland, TX (US)

( * ) Notice: Subject to any disclaimer, the term of this patent is extended or adjusted under 35 U.S.C. 154(b) by 46 days.

(21) Appl. No.: 15/784,655

(22) Filed: Oct. 16, 2017

(65) Prior Publication Data

US 2018/0112491 A1 Apr. 26, 2018

Related U.S. Application Data

(60) Provisional application No. 62/411,984, filed on Oct. 24, 2016, provisional application No. 62/415,001, filed on Oct. 31, 2016.

(51) Int. Cl.
*E21B 34/02* (2006.01)
*E21B 43/12* (2006.01)
*E21B 34/16* (2006.01)

(52) U.S. Cl.
CPC ..... *E21B 34/02* (2013.01); *E21B 34/16* (2013.01); *E21B 43/126* (2013.01)

(58) Field of Classification Search
CPC ..... E21B 34/02; E21B 34/16; E21B 43/126
See application file for complete search history.

(56) References Cited

U.S. PATENT DOCUMENTS 4,278,711 A * 7/1981 Sullivan ..... B21D 51/26 118/107
4,634,098 A 1/1987 Varden
5,263,682 A 11/1993 Covert et al.
5,377,955 A * 1/1995 Baker ..... F16K 3/0263 251/327
6,129,336 A 10/2000 Sandling et al.
7,806,175 B2 10/2010 Hickie
7,896,312 B2 3/2011 Dalmasso et al.
8,272,433 B2 9/2012 Duhn et al.
9,057,448 B2 6/2015 Lymberopoulos
(Continued)

*Primary Examiner* — Matthew R Buck
*Assistant Examiner* — Aaron L Lembo
(74) *Attorney, Agent, or Firm* — Peter L. Brewer; Thrive IP

(57) ABSTRACT

A method for pre-pressurizing fluid control valves is provided. The fluid control valves may be part of a hydraulic fracturing tree, or may be part of a so-called zipper frac manifold. In either instance, the method uses a lubrication unit for pre-pressurizing the cavity of a valve by injecting lubricant under high pressure. The fracturing tree or zipper frac manifold is useful for conducting hydraulic fracturing operations as part of the completion of a well. Each control valve has an upper lube fitting extending to an upper lube channel which communicates with an upper pocket. Similarly, each control valve includes a lower lube fitting extending to a lower lube channel which communicates with a lower pocket. A pressurized lubricating fluid is forced into the lube fittings to pre-pressurize the control valves prior to the fracturing fluid passing through the control valves. The method of pre-pressurizing the control valve restricts scarring by the fracturing fluid of the internal components of the control valve by equalizing pressure.

7 Claims, 7 Drawing Sheets

(56) References Cited

U.S. PATENT DOCUMENTS

| | | | | |
|---|---|---|---|---|
| 9,222,345 | B2 | 12/2015 | Conrad | |
| 9,255,469 | B2 | 2/2016 | Conrad | |
| 9,429,241 | B2 | 8/2016 | Eagen | |
| 9,850,740 | B2 * | 12/2017 | Atencio | F16K 3/207 |
| 2014/0124298 | A1 | 5/2014 | He et al. | |
| 2015/0345272 | A1 | 12/2015 | Kajaria et al. | |
| 2016/0123109 | A1 * | 5/2016 | Hoang | F16K 3/316 166/90.1 |
| 2016/0168970 | A1 | 6/2016 | Kajaria et al. | |
| 2016/0201811 | A1 | 7/2016 | Hunter et al. | |
| 2016/0208570 | A1 | 7/2016 | Ayres et al. | |
| 2017/0146189 | A1 | 5/2017 | Herman et al. | |
| 2017/0275980 | A1 | 9/2017 | Kajaria | |
| 2017/0276293 | A1 * | 9/2017 | McKim | E21B 34/02 |
| 2018/0058171 | A1 * | 3/2018 | Roesner | E21B 33/068 |

* cited by examiner

PORTABLE LUBRICATION UNIT FOR A HYDRAULIC FRACTURING VALVE ASSEMBLY, AND METHOD FOR PRE-PRESSURIZING VALVES

STATEMENT OF RELATED APPLICATIONS

This application claims the benefit of U.S. Ser. No. 62/411,984 entitled "Hydraulic Fracturing Tree Having Lubrication Unit, and Method." That application was filed on Oct. 24, 2016, and is incorporated herein in its entirety by reference.

This application also claims the benefit of U.S. Ser. No. 62/415,001 entitled "Portable Lubrication Unit For a Hydraulic Fracturing Valve Assembly, and Method for Pre-Pressurizing Valves." That application was filed on Oct. 31, 2016, and is incorporated herein in its entirety by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce selected aspects of the art, which may be associated with various embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

The present disclosure relates to the field of well completion. More specifically, the present disclosure relates to fluid control valves for a completion tree used for hydraulic fracturing. The present disclosure further relates to an automatic lubrication unit configured for use with a hydraulic fracturing tree.

DISCUSSION OF TECHNOLOGY

In the drilling of an oil and gas well, a near-vertical wellbore is formed through the earth using a drill bit urged downwardly at a lower end of a drill string. The drill bit is rotated in order to form the wellbore, while drilling fluid is pumped through the drill string and back up to the surface on the back side of the pipe. The drilling fluid serves to cool the bit and flush drill cuttings during rotation.

After drilling to a predetermined vertical depth, the wellbore may be deviated. The deviation may be at a "kick-off" angle of, for example, 45 degrees or 60 degrees. Alternatively, the deviation may be about 90 degrees. In this instance, a wellbore having a substantially horizontal leg is formed.

Within the last two decades, advances in drilling technology have enabled oil and gas operators to economically "kick-off" and steer wellbore trajectories from a generally vertical orientation to a generally horizontal orientation. The horizontal "leg" of each of these wellbores now often exceeds a length of one mile. This significantly multiplies the wellbore exposure to a target hydrocarbon-bearing formation (or "pay zone"). For example, for a given target pay zone having a (vertical) thickness of 100 feet, a one-mile horizontal leg exposes 52.8 times as much pay zone to a horizontal wellbore as compared to the 100-foot exposure of a conventional vertical wellbore.

During the drilling process, the drill string and bit are periodically removed and the wellbore is lined with a string of casing. An annular area is formed between the string of casing and the formation penetrated by the wellbore. A cementing operation is then conducted in order to fill or "squeeze" the annular volume with cement along the length of the wellbore casing. The combination of cement and casing strengthens the wellbore and facilitates the zonal isolation, and subsequent completion, of certain sections of potentially hydrocarbon-producing pay zones behind the casing.

During wellbore formation, it is common to place several strings of casing having progressively smaller outer diameters into the wellbore. A first string may be referred to as surface casing. The surface casing serves to isolate and protect the shallower, fresh water-bearing aquifers from contamination by any other wellbore fluids. Accordingly, this casing string is almost always cemented entirely back to the surface. The process of drilling and then cementing progressively smaller strings of casing is repeated several times below the surface casing until the well has reached total depth. In some instances, the final string of casing is a liner, that is, a string of casing that is not tied back to the surface but is hung from the lowest intermediate string of casing.

FIG. 1 provides a cross-sectional view of a wellbore 100 having been completed in a horizontal orientation. It can be seen that a wellbore 100 has been formed from the earth surface 101, through numerous earth strata 20*a*, 20*b*, . . . 20*h* and down to a hydrocarbon-producing formation 150. The subsurface formation 150 represents a "pay zone" for the oil and gas operator. The wellbore 100 includes a vertical section 105 above the pay zone 150, and a horizontal section 107. The horizontal section 107 defines a heel 115 and a toe 117, along with an elongated leg there between that extends along the pay zone 150.

In connection with the completion of the wellbore 100, several strings of casing having progressively smaller outer diameters have been cemented into the wellbore 100. These include a string of surface casing 120, and may include one or more strings of intermediate casing 130, and finally, a production casing 140. The final string of casing 140, referred to as a production casing, is typically cemented 143 into place. In some completions, the production casing 140 has external casing packers ("ECP's), swell packers, or some combination thereof spaced across the productive interval. This creates compartments between the swell packers for isolation of zones and specific stimulation treatments.

In FIG. 1, a column of cement 127 is placed into an annular space residing between the surface casing 120 and the surrounding formation 20*a*, 20*b*. A so-called cement shoe 128 is provided at the lower end of the surface casing 120. Similarly, a column of cement 137 is optionally placed in an annular space residing between the intermediate casing string 130 and the surrounding formation 20*d*, 20*e*. A cement shoe 138 is again provided at the lower end of the casing string 130.

As part of the completion process and before the production tubing string is installed, the production casing 140 is perforated at a desired level 107. This means that lateral holes (or "perforations" 145) are shot through the casing 140 and the cement column 143 surrounding the casing 140. The perforations 145 allow reservoir fluids to flow into the wellbore 100. Where swell (or other) packers are provided, the perforating gun penetrates the casing 140, allowing reservoir fluids to flow from the rock formation 20*h* into the horizontal leg 107 of the wellbore 100 and into selected zones.

After perforating, the formation 20*h* is typically fractured at the corresponding zone. Hydraulic fracturing consists of injecting water with friction reducers or viscous fluids (usually shear thinning, non-Newtonian gels or emulsions) into a formation at such high pressures and rates that the reservoir rock parts and forms a network of fractures 146. The fracturing fluid is typically mixed with a proppant material such as sand, ceramic beads or other granular materials. The proppant serves to hold the fractures 146 open after the hydraulic pressures are released. In the case of so-called "tight" or unconventional formations, the combination of fractures and injected proppant substantially increases the flow capacity, or permeability, of the treated reservoir.

FIG. 1 demonstrates a series of fracture half-planes 146 along the horizontal section 107 of the wellbore 100. The fracture half-planes 146 represent the orientation of fractures that will form in connection with a perforating/fracturing operation. According to principles of geo-mechanics, fracture planes will generally form in a direction that is perpendicular to the plane of least principal stress in a rock matrix. Stated more simply, in most wellbores, the rock matrix will part along vertical lines when the horizontal section of a wellbore resides below 3,000 feet, and sometimes as shallow as 1,500 feet, below the surface. In this instance, hydraulic fractures will tend to propagate from the wellbore's perforations 145 in a vertical, elliptical plane perpendicular to the plane of least principal stress. If the orientation of the least principal stress plane is known, the longitudinal axis of the leg 107 of a horizontal wellbore 100 is ideally oriented parallel to it such that the multiple fracture planes 146 will intersect the wellbore at-or-near orthogonal to the horizontal leg 107 of the wellbore, as depicted in FIG. 1.

In support of the formation fracturing process, a so-called hydraulic "frac" tree 50 is installed at the surface 101. An illustrative tree is seen at 200 in FIG. 2. The tree 5 serves to connect fluid hoses and pumps, and to direct hydraulic fracturing fluid into the wellbore. Those of ordinary skill in the art understand that formation fracturing fluid is pump through the hoses, through control valves associated with the fracturing tree, and down the wellbore 4 until it exits exposed perforations. This pumping process is frequently done in horizontal stages, enabling specific zones to be sequentially isolated along the horizontal section 4*c*.

The ability to replicate multiple vertical completions along a single horizontal wellbore is what has made the pursuit of hydrocarbon reserves from unconventional reservoirs, and particularly shales, economically viable within relatively recent times. This revolutionary technology has had such a profound impact that Baker Hughes Rig Count information for the United States indicates only about one-fourth (26%) of wells being drilled in the U.S. are classified as "Vertical", whereas the other three-fourths are classified as either "Horizontal" or "Directional" (62% and 12%, respectively). That is, horizontal wells currently comprise approximately two out of every three wells being drilled in the United States.

A complication associated with the formation fracturing process is the wear upon the surface equipment used during the fracturing process. In this respect, the proppant placed within the fracturing fluid is highly abrasive, particularly when pumped through control valves at high flow rates. The control valves include a body in which is placed a movable gate which functions to controllably allow or prevent the flow of fluids through the control valve. The internal gate loosely abuts a pair of seats positioned on either side of the gate.

Oftentimes, the control valves are arranged in series, forming a so-called hydraulic fracturing tree or "valve tree." During the fracturing process, the fracturing fluid passes through internal components of the valves along the valve tree. The passage of the fracturing fluid, and especially the abrasive proppant which constitutes a part of the fracturing fluid, causes scarring, pitting or other damage to the internal components of the valves, such as the gates, seats, stem and body. Once the valve becomes scarred or damaged, the valves and, possibly, the entire tree, must be repaired or replaced to ensure the safe operation of the well. Such repairs are both costly and time consuming to the operator of the completion equipment.

Some operators have attempted to cure this problem by lubricating the gate of the valves. This is currently done by applying a viscous lubrication fluid to the valves, cycling the gate of each of the valves, lubricating the valves again, and then moving the gate again. However, when moving the gate from a closed position to an open position, pressure in the body of the tree is released. This, in turn, creates a pressure differential from the bore of the fracturing tree to the body of the valves when the fracturing operation begins.

Upon pressurization, the pressure in the bore is typically 6,500 to 8,500 psi but only 0 psi in the gate cavity and seats. Thus, there is a 6,500 to 8,500 psi differential. When the gate is moved to its open position, the pressure differential allows the abrasive fracturing fluid and proppant to be forced between the gate and seat in the opened valve until the body cavity equalizes with the pumping pressure applied to the valve bore and well. Thus, once again the fracturing fluid and proppant is potentially damaging the internal valve components, creating scarring and pits therein. The build-up of such damage may result in gates no longer being capable of moving between open and closed positions. In a worst-case scenario, well control may be compromise since the tree cannot be fully shut in.

Accordingly, it is desirable provide a portable lubrication unit that may be carried to a well site, and then fluidically connected to the control valves of a fracturing tree. In this way, the gate cavity may be pre-pressurized in such a manner as to restrict the abrasive fluids associated with the perforating process from entering the cavity and damaging the internal components of the valves. Further, a need exists for a frac tree fitted with a lubricant pump that enables lubricating fluid to be pumped into the gate cavity at very high pressure before fracturing fluid is pumped downhole. Still further, a need exists for a process of pre-pressurizing control valves along an injection tree or injection manifold before a hydraulic fracturing fluid is injected into a wellbore for formation fracturing.

SUMMARY OF THE INVENTION

A portable lubrication unit for a hydraulic fracturing tree is provided herein. The hydraulic fracturing tree is configured to reside over a wellbore, and to enable the control of injection fluids into the wellbore and to contain wellbore pressure. Thus, the fracturing tree is essentially a high pressure wellhead.

The lubrication unit first comprises a portable platform. The platform may be a trailer, a skid or the bed of a truck. The portable platform carries the equipment necessary for pressurization of fluid control valves associated with the fracturing tree. The platform is taken to well sites, which frequently are in remote locations.

The lubrication unit also includes an air compressor and a pressure regulator. Because of the extremely high pressures involved, the pressure regulator will likely be separate from the vessel that makes up the air compressor. Thus, an air line will carry pressurized air from the air compressor to the pressure regulator.

The lubrication unit will further include a lubricating fluid reservoir. The lubricating fluid reservoir defines a vessel holding a lubricating fluid. Suitable pipes, gauges and valves are provided for receiving pressurized air from the pressure regulator, monitoring pressure of the reservoir, and releasing the pressurized lubricating fluid from the reservoir. A high pressure lubrication line then extends from the lubricating fluid reservoir to the fracturing tree.

It is preferred that the portable lubrication unit also include an in-line check valve along the high pressure lubrication line. The check valve prevents lubricating fluid from backing back into the lubricating fluid reservoir from the wellhead. In addition, a pressure switch is preferably provided. In one aspect, the pressure switch generates an electrical signal when a certain pressure level is reached. The signal may initiate a shut-off of the air compressor or send a separate signal to an operator.

The high pressure lubrication line may feed into a manifold, that then distributes lubrication fluid directly to individual fluid control valves along the fracturing tree. Alternatively, the lubrication line may travel along the fracturing tree, and tee off to individual lube fittings adjacent the control valves.

A hydraulic fracturing tree having a novel lubrication unit is also provided herein. The hydraulic fracturing tree first comprises a body. The body has a cylindrical flow passage that is in fluid communication with the subsurface wellbore. The body is generally made up of a series of spacers having cylindrical bores therein.

The hydraulic fracturing tree also has at least one fluid control valve along the body. Preferably, the at least one control valve is at least three control valves spaced vertically along the body. Closing the valves limits fluid communication between the cylindrical body of the tree and the wellbore, and vice versa. The spaces reside between the respective control valves.

Each of the at least one fluid control valves includes an internal gate cavity. The gate cavity is in fluid communication with the flow passage of the body.

Each of the at least one fluid control valves also has a gate. The gate is movably mounted within the internal gate cavity. Preferably, this is done through rotation of an actuator arm that produces linear movement of the gate within the internal gate cavity. Movement of the gate is between a valve open position and a valve closed position. In combination with the body, the gate defines an upper pocket and a lower pocket.

Each of the at least one fluid control valves also includes a pair of seats. The seats are placed at opposing sides of the gate. In operation, if a frac valve is in the run of the frac tree, there will be one seat on top of the gate and one seat on the bottom of the gate. The gate is movable, or "floating." This means if the gate is in its gate-closed position and the well has more pressure coming from the formation than what is on top of the frac tree, the gate will push against the top seat and form a seal. This would be an example of the frac valve containing wellbore pressure. If the well is undergoing hydraulic fracturing and the gate is in its gate-closed position, the greatest pressure is on top of the gate. In this instance, the gate seals against the bottom seat, preventing the frac fluid from going downhole.

Each of the at least one fluid control valves further comprises a stem. The stem is mechanically coupled to the gate. Preferably, the stem sealingly extends through a bonnet. An actuator is coupled to the stem to translate the gate linearly between valve open and valve closed positions. In one aspect, the stem comprises a proximal end that is threadedly connected to the actuator, and a distal end mechanically connected to the gate. Preferably, the actuator comprises a hand lever and associated threaded cylinder configured such that manual rotation of the lever and cylinder selectively translates the gate between its valve open and its valve closed positions.

Each of the at least one fluid control valves also has an upper lube channel extending through the body and in fluid communication with the upper pocket, and a lower lube channel extending through the body and in fluid communication with the lower pocket. The control valve further has an upper lube fitting coupled to the upper lube channel, and a lower lube fitting coupled to the lower lube channel.

The upper pocket and/or the lower pocket are configured to be pressurized by a lubricating fluid that is placed under pressure. The pre-pressurization is at least as great as a determined formation parting pressure, and preferably at least as great as a hydraulic fracturing pressure. Pre-pressurization occurs by passing the lubricating fluid through the upper lube fitting, through the lower lube fitting, or both, and into the gate cavity. Pre-pressurization is done before hydraulic fluid is passed through the fracturing tree.

Preferably, each of the at least one control valves further comprises an upper flange and a lower flange, with each of the upper and lower flanges configured to be mechanically and sealingly connected in line with the body by means of a plurality of bolts. Preferably, the fracturing tree comprises several control valves in series, each of which has an upper flange and a lower flange, and each of which is pre-pressurized.

The tree further comprises a reservoir of lubricant, and a high pressure pump. The pump is configured to pump the lubricating fluid from the reservoir, through the lube fittings and into the cavity pockets of the gates. Appropriate pressure sensors, pressure gauges, lines and fittings are provided for pumping as described above.

A method of pressurizing at least one fluid control valve is also provided herein. Pressurization is provided to each of the control valves along a fracturing tree, with the valves being in their valve open positions during pressurization. Thereafter, hydraulic fracturing fluid is injected through the valves and down into the wellbore. In this way, fracturing fluid is directed through the flow channel while high pressure provided by the lubricating fluid within the upper pocket and/or lower pocket of the gate cavity substantially prevents the hydraulic fracturing fluid from traveling around the gate and scarring the seats and related hardware.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

As used herein, the term "hydrocarbon" refers to an organic compound that includes primarily, if not exclusively, the elements hydrogen and carbon. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient conditions. Hydrocarbon fluids may include, for example, oil, natural gas, condensate, coal bed methane, shale oil, shale gas, and other hydrocarbons that are in a gaseous or liquid state.

As used herein, the term "fluid" refers to gases, liquids, and combinations of gases and liquids, as well as to combinations of gases and fine solids, and combinations of liquids and fine solids.

As used herein, the term "subsurface" refers to geologic strata occurring below the earth's surface.

The term "subsurface interval" refers to a formation or a portion of a formation wherein formation fluids may reside. The fluids may be, for example, hydrocarbon liquids, hydrocarbon gases, aqueous fluids, or combinations thereof.

The terms "zone" or "zone of interest" refer to a portion of a formation containing hydrocarbons. Sometimes, the terms "target zone," "pay zone," or "interval" may be used.

As used herein, the term "wellbore" refers to a hole in the subsurface made by drilling or insertion of a conduit into the subsurface. A wellbore may have a substantially circular cross section, or other cross-sectional shape. As used herein, the term "well," when referring to an opening in the formation, may be used interchangeably with the term "wellbore."

The term "abrasive material" or "abrasives" refers to small, solid particles mixed with or suspended in the jetting fluid to enhance erosional penetration of: (1) the pay zone; and/or (2) the cement sheath between the production casing and pay zone; and/or (3) the wall of the production casing at the point of desired casing exit.

The terms "tubular" or "tubular member" refer to any pipe, such as a joint of casing, a portion of a liner, a joint of tubing, a pup joint, or coiled tubing.

DESCRIPTION OF SPECIFIC EMBODIMENTS

Figure 1:
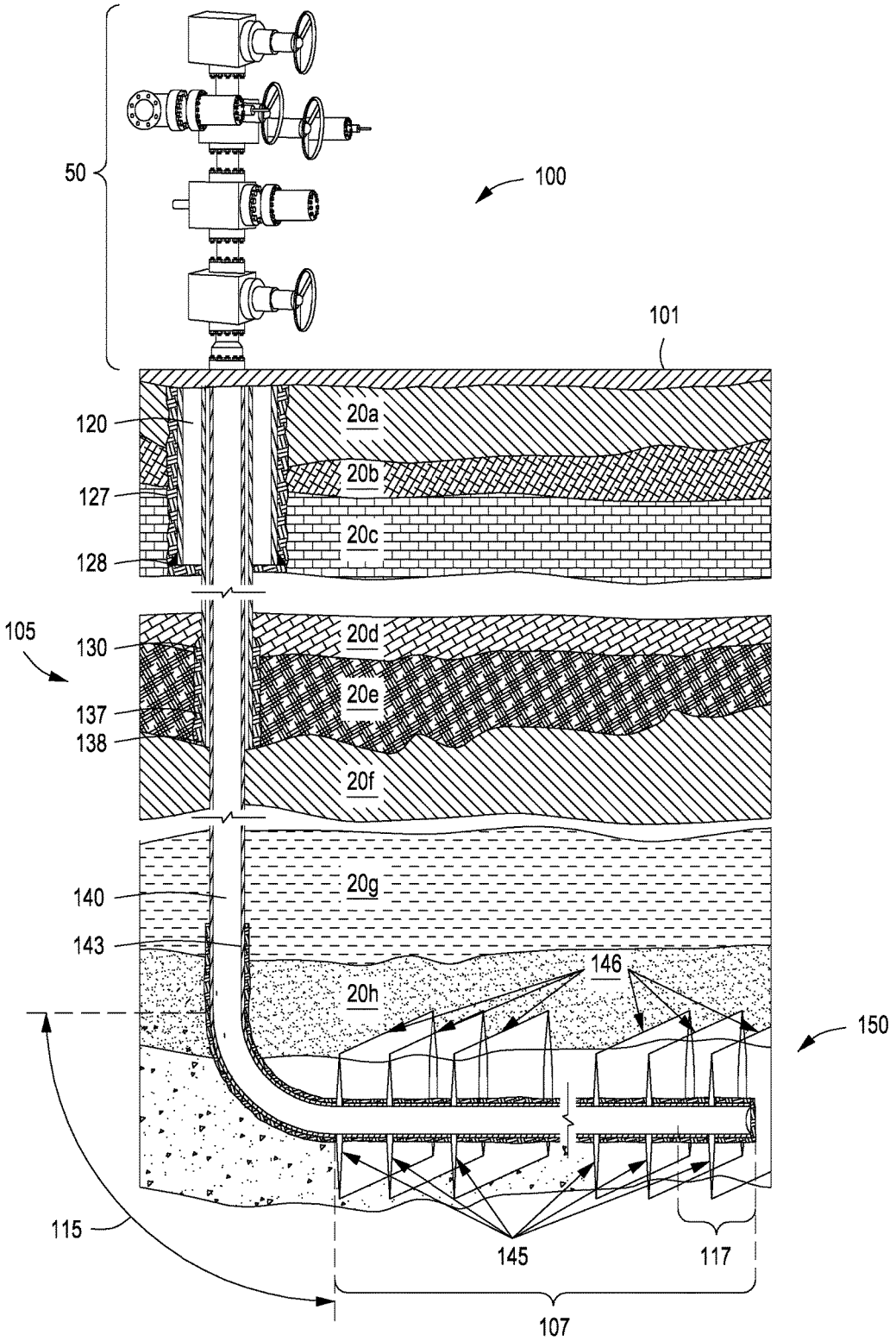
FIG. 1 is a cross-sectional view of an illustrative wellbore. The wellbore has been horizontally completed, with half-fracture planes shown in 3-D along a horizontal leg of the wellbore to illustrate fracture stages and fracture orientation relative to a subsurface formation.
Figure 2:
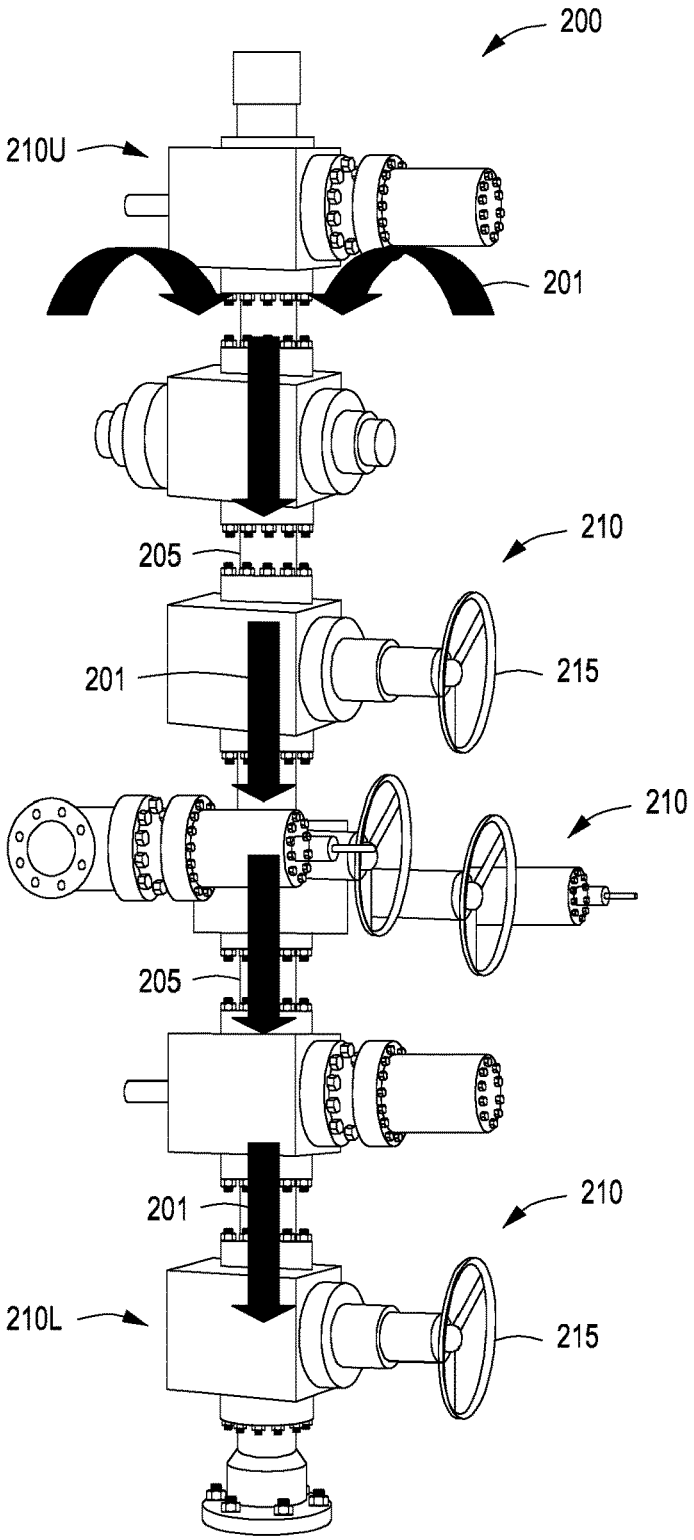
FIG. 2 is a perspective view of a vertical series of control valves of the present invention arranged as a fracturing tree, in one embodiment. Spacer bodies (or "spools") are provided between the fluid control valves.

FIG. 2 is a perspective view of a hydraulic fracturing tree 200. The fracturing tree 200 comprises a series of control valves 210. The control valves 210 are arranged vertically along a metal body to form the fracturing tree 200. The control valves 210 provide selective fluid communication between fluid lines (not shown in FIG. 2) such as hydraulic fracturing fluid lines, and a wellbore.

In the illustrative view of FIG. 2, Arrows 201 are shown. The Arrows 201 indicate a direction of travel of a hydraulic fracturing fluid. The fracturing fluid is injected through an uppermost flow control valve 210U, down the tree 200, and into a wellbore (such as wellbore 100) at a pressure that is in excess of a determined formation parting pressure. In this way, the subsurface formation 20*h* may be fractured under hydraulic pressure. For example, a subsurface formation parting pressure may be 6,500 psi, while a hydraulic pumping pressure for the fracturing fluid may be at 8,000 psi.

Each control valve 210 comprises a gate (shown at 260 in FIG. 3) fabricated from a metal material. The gate 260 is translated linearly within a gate cavity (shown at 250 in FIG. 3) in response to movement of an actuator. In the arrangement of FIG. 2, the actuators are valve handles 215. Each handle 215 is manually rotated to open and close a respective valve 210. Of course, it is understood that the gates 260 may alternatively be translated remotely using a motor (not shown) controlled through a wireless receiver and/or hydraulic pistons controlled by an HPU or accumulator unit.

The control valves 210 are stacked along a central body 205. In one aspect, the control valves 210 form the central body 205. In another aspect, the central body 205 is made up of a series of so-called spacer spools. The spacer spools are essentially tubular subs that are added between adjacent fluid control valves (or "frac valves") 210. The spacer spools 205 have studs coming out of the bodies instead of bodies that have API flanges on them. If the frac valves 210 have API flanges, those flanges are bolted to the flanges of the spacer spools 205. In any instance, the flow channels of the spacer spools 205 and the in-line control valves 210 form a continuous vertical bore, or flow channel (seen at 208 in FIG. 3 and in FIG. 4A). The bore 208 receives injection fluids through the respective control valves 210 as each gate 260 is translated to its open position.

Figure 3:
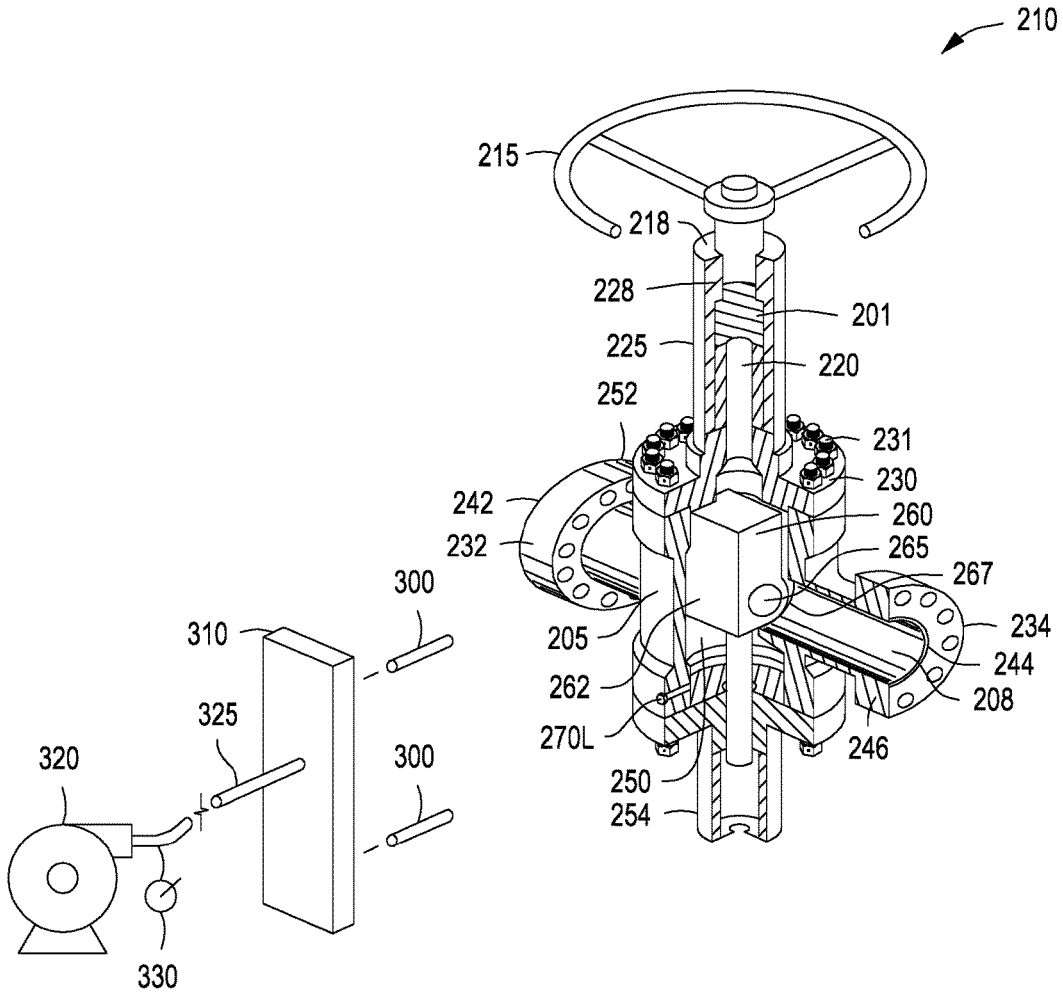
FIG. 3 is a perspective view, shown in partial cross-section, of a single control valve of FIG. 2. The valve has been rotated 90 degrees for better illustration.

FIG. 3 is an enlarged perspective view of a control valve 210 from FIG. 2, in one embodiment. The control valve 210 is shown in partial cross-section. In addition, the control valve 210 is rotated 90 degrees for illustrative purposes. Visible in FIG. 3 is a handle 215, or "hand wheel." The handle 215 resides at a proximal end of an elongated stem 220, and serves as a manual actuator. The handle 215 is shown oriented above the valve 210, though it is understood that the handle 215 actually extends laterally from the valve 210 in a horizontal manner as illustrated in FIG. 2.

The stem 220 extends into and resides rotationally within a barrel 225. The barrel 225, in turn, is "tee'd" to a flange 230. The flange 230 secures the barrel 225 to the central body 205. In the parlance of the industry, the flange 230 is referred to as a "bonnet." The bonnet 230 is secured to the body 205 through a plurality of bolts 231.

It is observed that opposing ends of the vertical bore 208 for the central body 205 itself also comprises a pair of opposing flanges 232, 234. A first port 242 is formed on one end of the body 205 associated with an upper flange 232, while a second port 244 is formed on another end of the body 205 and is associated with a lower flange 234. Generally, the ports 242 and 244 are aligned and form part of the vertical flow passage that defines the bore 208.

Each of the flanges 232, 234 includes a seal surface 246 for placement of a flange seal (not shown). The flange seal may be a gasket or an o-ring. The seal surface 246 enables sealing between an adjacent flange and connecting equipment. Other types of connections can be formed, although flanges are common for the pressure ratings of the control valves 210.

As noted, the valve barrel 225 includes a gate cavity 250 disposed between the first port 242 and the second port 244. The gate cavity 250 is configured to intersect the flow passage 208. Generally, the gate cavity 250 is disposed perpendicular to the flow passage 208, although other angles can be used. The gate 260 resides within the gate cavity 250 and may be selectively positioned to block the flow passage 208 and control fluid flow there through.

The gate 260 defines an elongated body 262. In the illustrative arrangement of FIG. 3, the body 262 has a rectangular profile. When the gate 260 is in its closed position, the body 262 blocks the flow of fluids through the flow passage 208. However, the body 262 includes a through opening, or channel 265. The body 262 may be translated to align the channel 265 with the flow passage 208 in order to provide an open position that allows the flow of fluids down the vertical flow passage 208 en route to the wellbore 100.

The combination of the gate 260 and the gate cavity 250 forms an upper gate pocket (seen at 252 in FIGS. 4A and 5A) above the gate 260, and a lower gate pocket (seen at 254 in FIGS. 4A and 5A) below the gate 260. The pockets 252, 254 provide clearance that allows the gate 260 to flex up and down within the gate cavity 250 in response to fluid pressure. The size and volume of the gate pockets 252 and 254 are dependent upon the location of the gate 260 within the gate cavity 250, for as the gate 260 flexes downwardly, the volume of the upper gate pocket 252 increases, while the volume of the lower gate pocket 254 decreases, and visa-versa as the gate 260 flexes upwardly.

To effectively control the flow of fluids through the flow passage 208, a seat 267 is generally disposed on each side of the gate cavity 250 and the gate 260. In the closed position, the seat 267 generally abuts the gate 260 to limit the flow of fluids there through. When the valve 210 is closed, meaning that the flow channel 265 is out of alignment with the flow passage 208, it can be said that the gate 260 is seated in a closed position, and when the valve 210 is open, meaning that the flow channel 265 is aligned with the flow passage 208, it can be said that the gate 260 is seated in an open position.

It can be appreciated that when a gate 260 is moved to its valve open position, hydraulic fracturing fluids under extremely high pressure, e.g., greater than 7,000 psi, will surge through the gate cavity 250. This has the potential to create significant damage to the seats 267, the gate body 262 and all hardware associated with the valve 210. Therefore, it is desirable herein to provide a valve system and associated completion process wherein each of the valves 210 is pre-pressurized as described further below.

Referring again to the upper flange 232, the upper flange 232 resides above the upper gate pocket 252. The stem 220 extends through the upper flange 232 and into the upper gate pocket 252. The stem 220 can be rotated within the bonnet 230 in response to rotation of the handle 215. Rotation of the stem 220 linearly translates the gate 260 within the gate cavity 250. This linear movement is caused by rotation of a threaded surface 226 formed along the stem 220 such that rotation of the cylinder 218 effectively moves the stem 220 and the gate 260 in a translating motion. In the embodiment shown, the movement of the gate 260 is at a perpendicular angle to the flow passage 208, although the angle can vary if so designed.

As noted, the stem 220 can be translated by a manual or motorized mechanical actuator. Generally, an actuator 215 can be a hand wheel, motor-driven gear, or other movable element. One or more seals 228 is disposed between the stem 220 and the barrel 225 to generally eliminate leakage to the outside of the valve 210. A cylinder 218 is mounted to the top end of the bonnet barrel 225 and about the stem 220. Rotation of the actuator 215 turns the cylinder 218, which threadedly engages the stem 220 to translate the gate 260.

The valve 210 also includes grease (or lube) fittings 270. An upper fitting 270U resides along a first end of the body 205, while a lower fitting 270L resides along a second end of the body 205. The upper lube fitting 270U is coupled to and in fluid communication with an upper lube channel 27U, while the lower lube fitting 270L is coupled to and in fluid communication with a lower lube channel 27L. Each of the upper 27U and lower 27L lube channels extends through the body 205.

Each of the upper 270U and lower 270L lube fittings is configured to receive a high pressure line 300. High pressure lines 300 are shown in FIG. 3 extending away from the lube fittings 270U, 270L. The lines 300 define a pair of novel high pressure lubricating lines 300. The lubricating lines 300 receive lubricating (or viscous) fluid and direct the fluid into the cavity 250.

Each of the high pressure lubricating (or "lube") lines 300 is coupled to a high pressure pump 320. A viscous high pressure cleaning or lubricating fluid is pressurized by the high pressure pump 320. The lubricating fluid is then pumped through the high pressure lines 300 into the upper 270U and lower 270L lube fittings where it is conveyed through the lube channels and into the upper 252 and/or lower 254 gate pockets, respectively.

The high pressure pump 285 and the high pressure lines 200 may be part of a high pressure pumping system which will operate off of an electrical or pneumatic power source. The high pressure system will include a high flow air compressor having a pressure regulator with a pressure gauge. The high pressure pumping system will also include an air lubricator, a lubrication fluid, an in-line check valve and pressure switch. Optionally, the high pressure pumping system will include an air dryer.

In one aspect, the high pressure pump 320 pumps lubricating fluid through a single lubrication line 325 and into a manifold 310. From the manifold 310, lubricating fluid is distributed to appropriate high pressure lines 310 and then delivered to the upper 270U and lower 270L lube fittings.

Where three or four flow control valves 210 are placed in a frac tree 200 in series, the manifold 310 may distribute lubricating fluid to corresponding sets of upper 270U and lower 270L lube fittings for each valve 210.

Figure 4A:
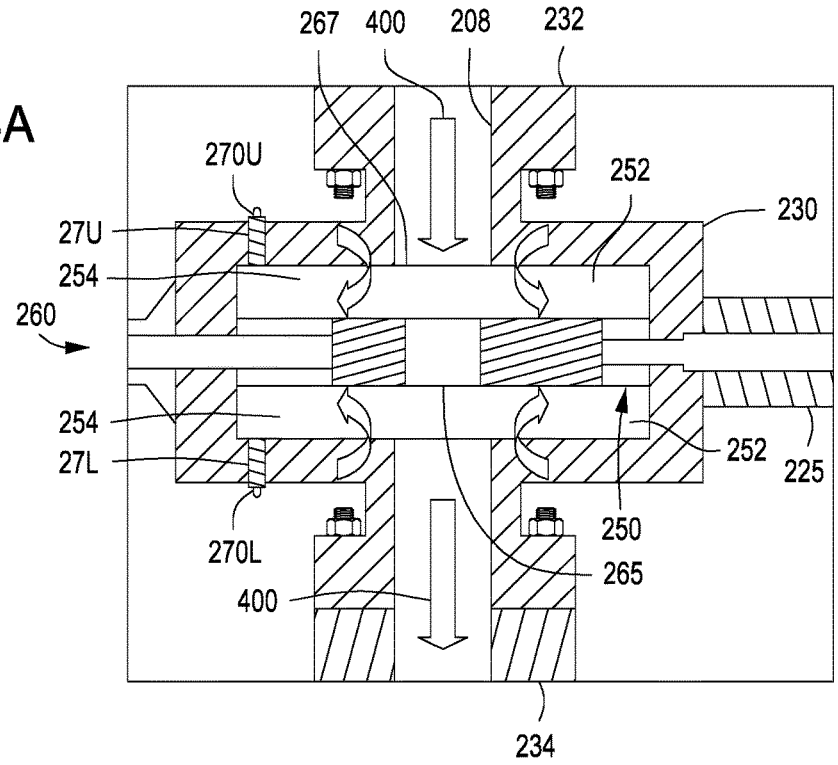
FIG. 4A is a perspective view of a portion of an illustrative control valve of the fracturing tree of FIG. 2. The valve is shown in cross-section.
Figure 4B:
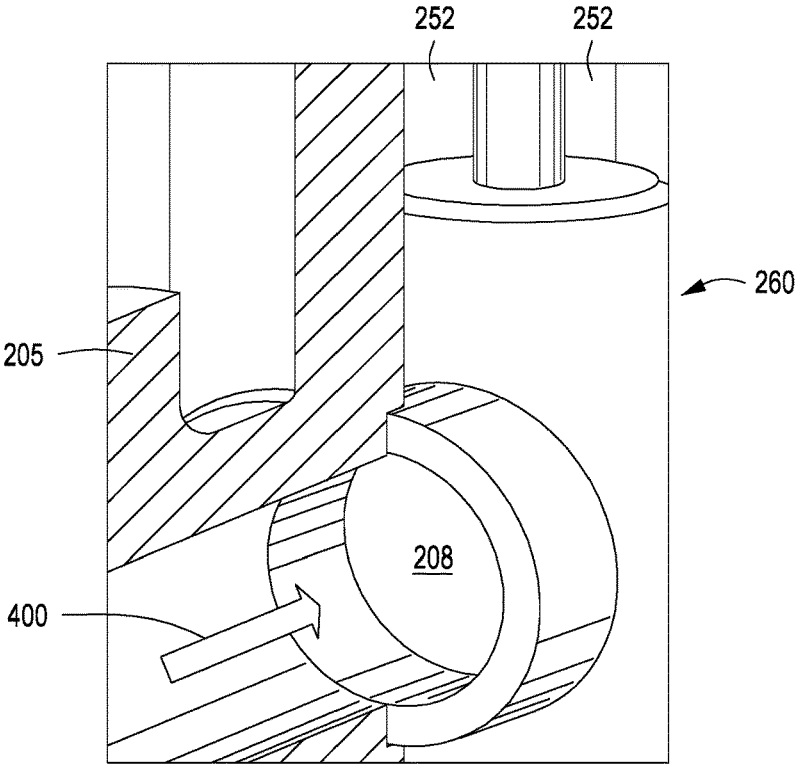
FIG. 4B is an enlarged view of a portion of the control valve of FIG. 4A.

FIG. 4A is a perspective view of a portion of an illustrative control valve 210 of the fracturing tree 200 of FIG. 2. The valve 210 is shown in cross-section. FIG. 4B is an enlarged view of a portion of the control valve 210 of FIG. 4A. In FIG. 4B, the valve has been rotated 90 degrees for illustrative purposes, allowing a view into the flow passage, or central bore 208 of a fracturing tree. In each of FIGS. 4A and 4B, fracturing fluids are being pumped down the bore 208. The upper 232 and lower 234 flanges of the valve 210 of the tree 200 are visible, along with the bonnet 230 of the valve 210.

The flow path for the fracturing fluids is indicated by Arrow 400. The fracturing fluids are being pumped by a high pressure pumping system, typically built into the bed of an over-the-road trailer (not shown) or onto a skid. It can be seen from FIGS. 4A and 4B that fluids are flowing down the bore 208 and through the cavity 250. As discussed above, the cavity 250 comprises an upper gate pocket 252 and a lower gate pocket 254.

As noted, the injection of the fracturing fluids (Arrow 400) with its abrasive proppant is extremely hard on the seat 267 of the valve 210. This is particularly true during start-up when fluids are first thrust across the valve 210, causing pitting and scarring. Accordingly, an improved high pressure pumping system is provided along with a method of injecting a fracturing fluid into a wellbore.

In use, a fracturing tree having one more control valves 210 is provided. The tree may be in accordance with FIG. 2. Before the pumping operation begins, the high pressure lubrication lines 300 are coupled to the upper 270U and lower 270L lube fittings. The high pressure lines 300 are also coupled to a conventional manifold 310 or, alternatively directly to a high pressure pump 320 and tested to ensure proper well control.

Once the high pressure lines 300 are properly connected to the lube fittings 270U, 270L, a pressure regulator 330 is set to an air pressure above a formation parting pressure. Moreover, the pressure regulator 330 is set to an air pressure that is above a desired fracturing pumping pressure. The high pressure pump 320 is then activated to pressurize the high pressure lines 300, wherein the pressure regulator 330 turns off the pump 320 when the set pressure is achieved through the sensing of pressure switches. Hence, lubricating or cleaning fluid passes through the high pressure lines 300 to the upper 270U and lower 270L lube fittings.

The lubrication fluid flowing through the lube fittings 270U, 270L passes into the upper and lower lube channels and into the upper gate pocket 252 and/or the lower gate pocket 254, depending on the position of the gate 260. The lubrication fluid thus fills and pressurizes the space between the gate 260 and the gate cavity 250. In this way, the valve 210 is pre-pressurized to a high pressure so that the incoming fracturing fluid and its proppant material does not flow about the gate 260, causing scarring or other damage to the gate 260 and its seat 267 or other internal components along the bore 208. Preferably, pre-pressurization is to a pressure that is 2%, or optionally 3 to 5%, greater than the determined hydraulic fracturing pressure. This minimizes the flow of the abrasive fracturing fluid into the cavity 250, and keeps hydraulic fracturing fluid moving through the flow channels 208, 244.

Figure 5A:
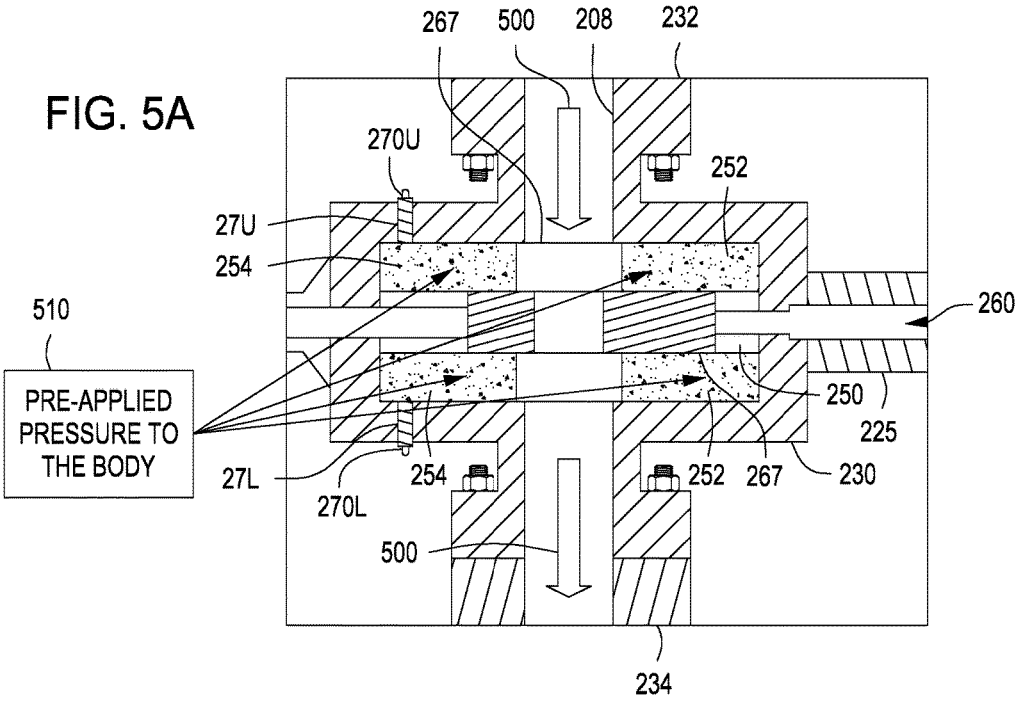
FIG. 5A is a perspective view of the illustrative control valve of FIG. 4A. Here, pressure is being pre-applied to the cavity of the control valve.
Figure 5B:
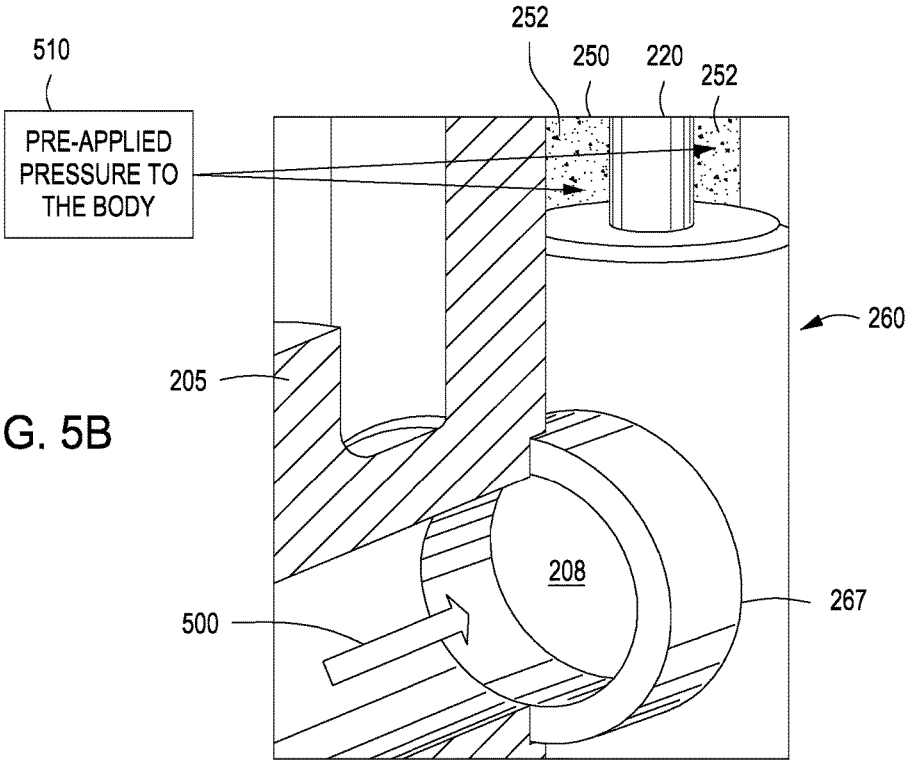
FIG. 5B is an enlarged view of a portion of the control valve of FIG. 5A.

FIG. 5A is a perspective view of the illustrative control valve 210 of FIG. 4A. Here, pressure is pre-applied to the seat 267 of the control valve 210. FIG. 5B is an enlarged view of a portion of the control valve 210 of FIG. 5A. Here, the valve 210 has been rotated 90-degrees for illustrative purposes, allowing a view into the flow passage, or central bore 208 of a fracturing tree. In the views of FIGS. 5A and 5B, it can be seen that a hydraulic fracturing fluid (Arrows 500) is being injected into the bore 208 of the frac tree 200. In addition, a lubricating fluid (Arrows 510) has been injected into the upper gate cavity 252 and the lower gate cavity 254. The valve 210 is in its gate-open position.

FIGS. 5A and 5B also provide beneficial views of the seats 267. As noted, the seats 267 reside at opposing ends of the gate cavity 250.

Once the valve 210, or a set of valves 210 in a frac tree 200, is pressurized, the high pressure fracturing pumping operations may begin. At this point, each of the valves 210 has been moved to its open position and has been pre-pressurized with lubricating fluid so that fracturing fluid may pass through the control valve 210 without scarring the gate 260 or seats 267. During this time, a lower most valve 210L on the frac tree 200 may be closed in order to seal the frac tree 200 during pre-pressurization.

The valve 210, the high pumping system and the methods herein permit the operator to pre-pressurize an individual valve 210 or a plurality of valves 210 along a valve tree 200 prior to the operation of the fracturing equipment. The pre-pressurization prevents or restricts the flow of abrasive fluids through the cavity of the valve and the resulting damage done to the internal components of the valve to eliminate the pressure differential between the cavity of the control valve and the well.

Preferably, the operator will also pre-pressurize the wing valves on the fracturing tree 200. This pre-pressurization takes place while the wing valves are in their closed position.

As part of the present disclosure, a portable lubrication unit is also offered herein. The lubrication unit is intended to be used with a hydraulic fracturing tree (including a zippered frac manifold) 200. The hydraulic fracturing tree offers one or more fluid control valves that control the injection of fluids into a wellbore 100.

Figure 6A:
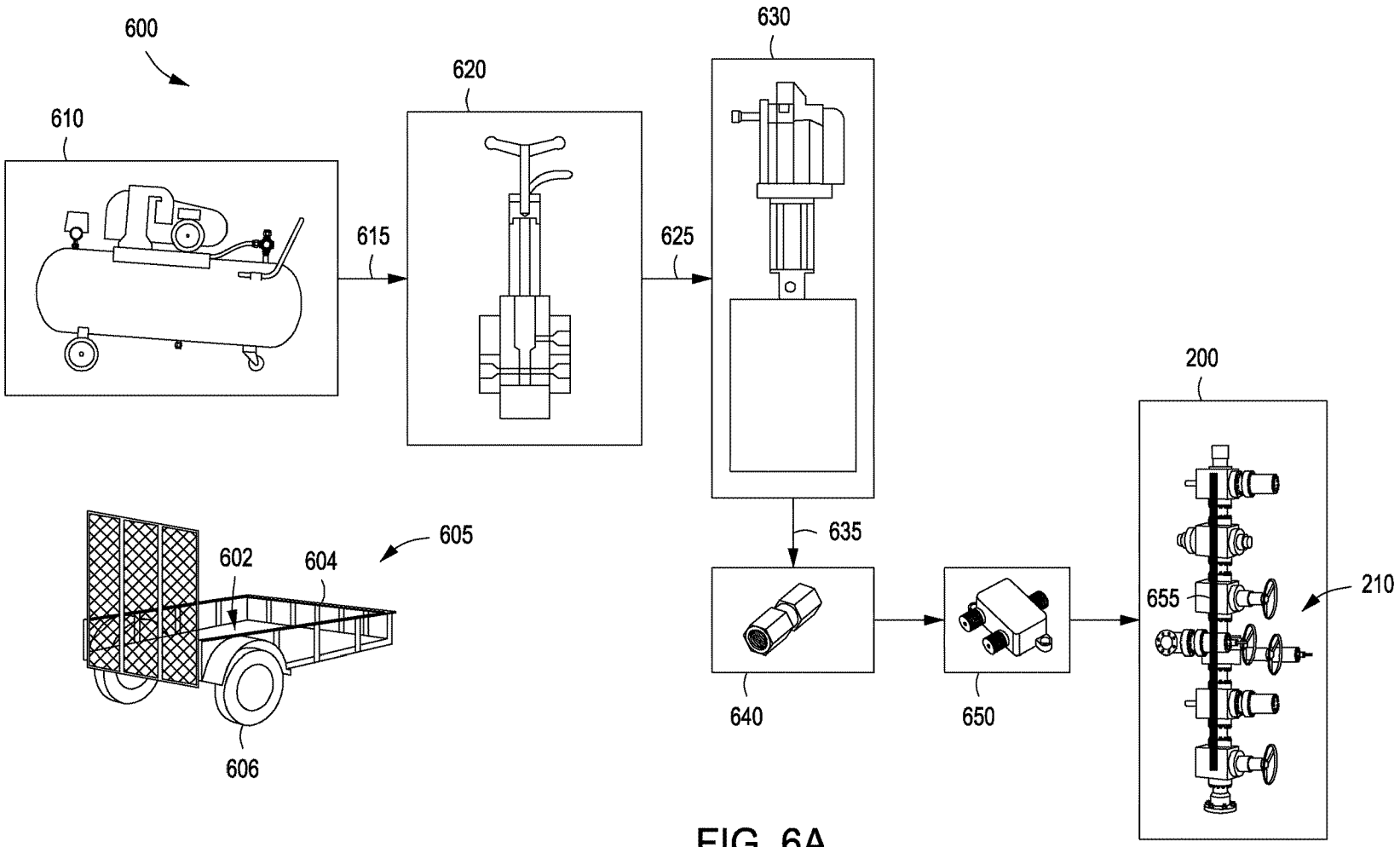
FIG. 6A is a flow chart showing a progression of components used for a portable lubrication unit of the present invention, in one embodiment.

FIG. 6A is a flow chart showing a progression of components used for a portable lubrication unit 600 of the present invention, in one embodiment. The illustrative lubrication unit 600 is configured to be used in pre-pressurizing fluid control valves 210 along a hydraulic frac tree 200. In FIG. 6A, a fracturing tree 200 is presented, comprising a stack of fluid control valves 210.

The lubrication unit 600 first comprises a portable platform 605. The platform 605 may be a trailer, a skid or the bed of a truck. In the view of FIG. 6A, a flatbed trailer is shown. The illustrative trailer 605 includes a bed 602, options side walls or rails 604, and wheels 606. The portable platform 605 carries the equipment necessary for pressurization of fluid control valves 210 associated with the fracturing tree 200. In this instance, the platform 605 will support at least an air compressor 610, a pressure regulator 620, a lubricating fluid reservoir 630, and associated high pressure hoses.

In operation, the platform 605 and supported lubrication unit 600 are taken to different well sites for hydraulic fracturing operations. Those of ordinary skill in the art will understand that such well sites are frequently in remote locations such as wells located in the Permian Basin, the Fayetteville Shale, the Eagle Ford Shale, the Marcellus Shale, the Bakken Shale, or other regions.

The lubrication unit 600 also includes an air compressor 610. The air compressor 610 is a device that converts power (using an electric motor, or a diesel or gasoline engine) into potential energy stored in pressurized air. The air compressor 610 will include a vessel that receives air in response to mechanical action of pistons, rotary screws or vanes, depending on the arrangement. When activated, air is directed into the vessel where it is held under pressure. The pressure is then released through an outlet that is fluidically connected to a high pressure air hose 615.

The lubrication unit 600 will also include a pressure regulator 620. Because of the uniquely high pressures involved, the pressure regulator 620 will likely be separate from the vessel that makes up the air compressor 610. Thus, the air hose 615 will carry pressurized air from the air compressor 610 to the pressure regulator 620. A pressure regulator hose 625, in turn, will direct the pressurized air on to a lubricating fluid reservoir 630.

The lubrication unit 600 will further include the lubricating fluid reservoir 630. The lubricating fluid reservoir 630 defines a vessel holding a lubricating fluid. Suitable pipes, gauges and valves are provided for receiving pressurized air from the pressure regulator, monitoring pressure of the lubricating fluid reservoir 630, and releasing the pressurized lubricating fluid from the reservoir 630. A high pressure lubrication line 635 then extends from the lubricating fluid reservoir 630 to the fracturing tree 200.

It is preferred that the portable lubrication unit 600 also include an in-line check valve 640. The in-line check valve 640 is placed along the high pressure lubrication line 635. The check valve 640 prevents lubricating fluid from backing back into the lubricating fluid reservoir 630 from the fracturing tree 200. In addition, a pressure switch 650 is preferably provided. In one aspect, the pressure switch 650 generates an electrical signal when a certain pressure level in the lubrication line 635 is reached. The signal may initiate a shut-off of the air compressor 630 or, alternatively, send a separate warning signal to an operator.

The high pressure lubrication line 635 may feed into a manifold (such as manifold 310 of FIG. 3, that then distributes lubrication fluid to individual fluid control valves 210 along the fracturing tree 200. Specifically, lubricating fluid will be delivered to respective flow control valves 210 through upper 270U and lower 270L lube fittings associated with each valve 210. Alternatively, the lubrication line 635 may travel to the fracturing tree 200, and then tee off to individual lube fittings 270U, 270L adjacent the control valves 210. In FIG. 6A, a lubricating fluid line 655 having multiple tee's is shown running along the frac tree 200.

Figure 6B:
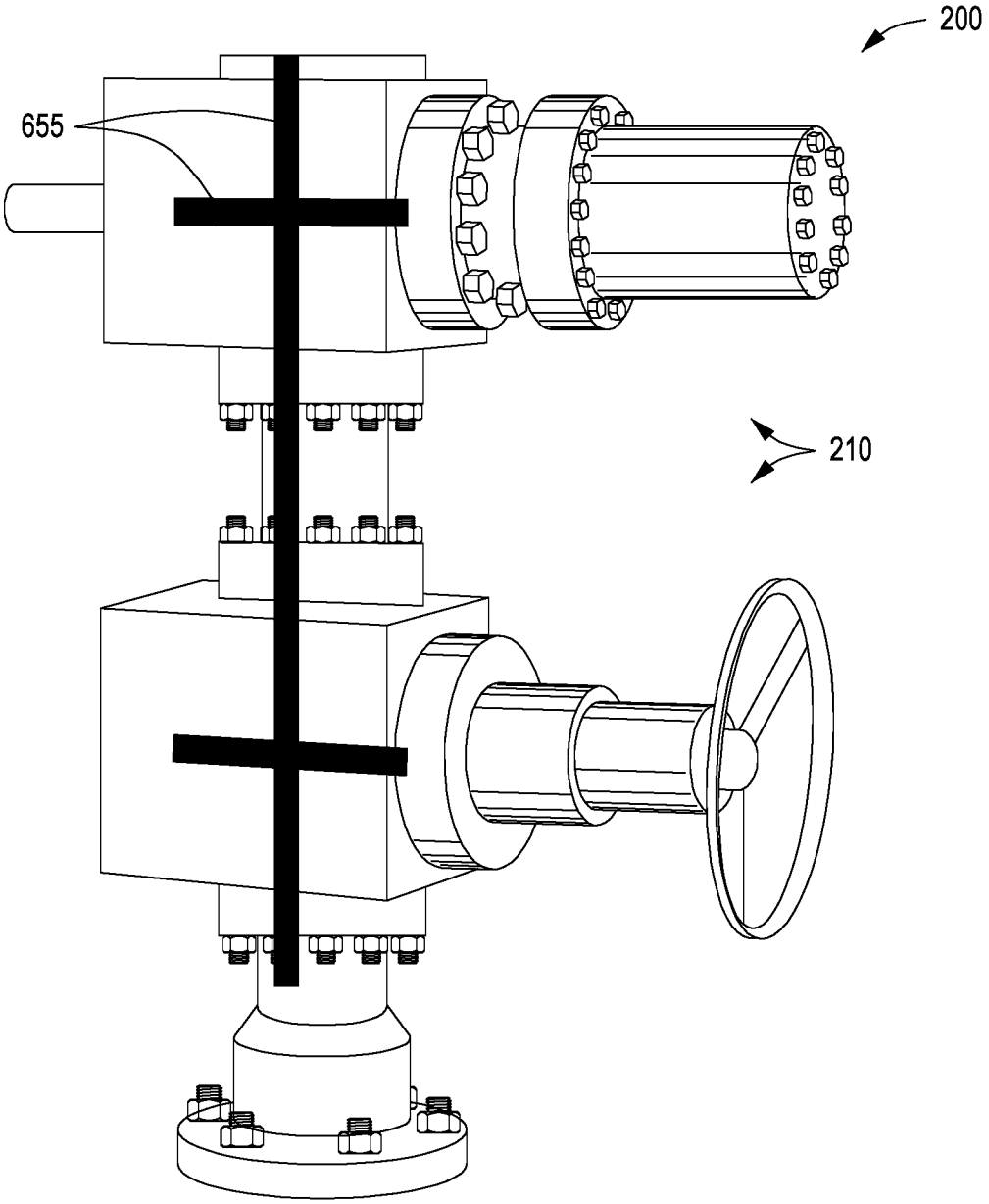
FIG. 6B is an enlarged view of a portion of the hydraulic fracturing tree of FIG. 6A. Darkened lines indicate areas of high pressure experienced within the frac tree during a formation fracturing operation.

FIG. 6B is an enlarged view of a portion of the hydraulic fracturing tree 200 of FIG. 6A. The high pressure lubricating fluid line 655 is more clearly seen. The line 655 is shown directing lubricating fluid (darkened lines) into the valves 210. Before pumping operations begin, the lubrication line 635 is fixed to the frac tree 200 and the high pressure lubrication lines 655 will be connected to each valve (one line at the front and one line at the back of each valve 210). Once connected, the equipment and all connections will be pressure tested to ensure 100% well control.

The pressure regulator 620 will be set to the necessary pressure required to operate the air compressor 610 and associated lubricant reservoir 630 to frac pumping pressure. Ideally, the fluid pressure regulator 620 will be set above pumping pressures. The pressure regulator switch 650 is set to shut off power source if a pre-set pressure is reached. Before the pressure pumping begins, the power source will supply the air compressor 610, any condensed fluid should be removed from the compressed air. Compressed air will drive a fluid pump associated with the lubricant reservoir. The fluid pump will supply lubricant to the single line 635 to the frac tree 200/frac manifold 310. The individual valve bodies will be supplied with lubrication fluid in front of the gate 260 and behind the gate 260 (such as through lube lines 270U and 270L). Once supplied, the valve bodies will build pressure which will in turn build pressure to the supply line 655 and back to the fluid pump associated with the lubricant reservoir 630 where the pressure switch 650 will shut off the power to the air compressor 610. Frac pumping operations can begin.

The portable high pressure lubrication unit and the pre-pressurization methods described herein have various benefits in the conducting of oil and gas completions, and especially the formation fracturing process. For example, it is observed that pre-pressurizing the valves with lubricant not only prevents abrasive hydraulic fracturing fluid from invading the gate cavity and scarring the seats, but also prevents the valves from becoming packed with proppant, e.g., sand.

Variations of the lubrication unit 600, the control valve 210 and the method of pre-pressurizing a control valve 210 are within the spirit of the claims, below. For example, an operator may pre-pressurize flow control valves associated with a so-called zipper frac manifold. A zipper frac manifold is used for fracturing multiple wells from a single valve system. It will be appreciated that the inventions are susceptible to modification, variation and change without departing from the spirit thereof.

What is claimed is:

1. A method of pre-pressurizing a valve, comprising:

placing a lubricant pressurization system onto a portable platform, the lubricant pressurization system comprising:

an air compressor;

a lubricant reservoir and associated fluid pump;

a high pressure air hose for delivering compressed air from the air compressor to the lubricant reservoir; and a high pressure lubricant line;

moving the portable platform with the lubricant pressurization system to a well site;

placing the high pressure lubricant line in fluid communication with one or more fluid control valves associated with a frac tree placed over a wellbore;

actuating the air compressor to power the fluid pump and to pressurize the lubricant within the high pressure lubricant line;

moving gates associated with the one or more fluid control valves into their open positions;

injecting lubricating fluid from the high pressure lubricant line into a cavity of each of the fluid control valves in order to pre-pressurize the respective cavities to a pressure of at least a determined formation fracturing pressure for a wellbore at the wellsite;

after the pre-pressurizing, injecting a hydraulic fracturing fluid down a central bore of the fracturing tree and down flow channels of the one or more fluid control valves while the respective cavities are packed with the lubricating fluid; and maintaining the pressure in the high pressure lubricant line while injecting the hydraulic fracturing fluid through the one or more fluid control valves and down the wellbore.

2. The method of pre-pressurizing a valve of claim 1, wherein the portable platform is a trailer, a skid, or the bed of a truck; and the one or more fluid control valves of the fracturing tree comprises a series of fluid control valves placed vertically over the wellbore, with each fluid control valve being in selective fluid communication with the wellbore;

and wherein the method further comprises further injecting the hydraulic fracturing fluid through the series of fluid control valves in order to fracture a subsurface formation.

3. The method of pre-pressurizing a valve of claim 2, wherein the lubricant pressurization system further comprises:

a pressure regulator placed in line along the high pressure air hose;

a check valve placed in line along the high pressure lubricant line; and a pressure switch also placed in line along the high pressure lubricant line.

4. The method of pre-pressurizing a valve of claim 3, wherein the method further comprises:

shutting off power to the air compressor when pressure in the high pressure lubricant line reaches a designated level.

5. The method of pre-pressurizing a valve of claim 3, wherein each of the fluid control valves comprises:

an upper flange and a lower flange, with each of the upper and lower flanges configured to be mechanically and sealingly connected in line with a body of the fracturing tree;

an internal gate cavity in fluid communication with a flow passage of the body, the internal gate cavity residing between the upper flange and the lower flange;

a gate movably mounted within the internal gate cavity for movement between a gate open position and a gate closed position, the gate in combination with the body defining an upper pocket and a lower pocket;

an upper seat placed above the upper pocket, and a lower seat placed below the lower pocket;

a stem mechanically coupled to the gate;

an actuator coupled to the stem configured to translate the stem and coupled gate linearly within the internal gate cavity;

an upper lube channel extending through the body and in fluid communication with the upper pocket, and a lower lube channel extending through the body and in fluid communication with the lower pocket; and an upper lube fitting coupled to the upper lube channel, and a lower lube fitting coupled to the lower lube channel.

6. The method of pre-pressurizing a valve of claim 5, wherein:

the at least one fluid control valve comprises at least three fluid control valves; and the gate of each fluid control valve comprises a channel such that when the gate is seated in its valve open position, the channel is aligned with the flow passage of the body, but when the gate is translated to its valve closed position, the channel is out-of-alignment with the flow channel and floatingly prevents the flow of injection fluids through the gate cavity.

7. The method of claim 2, further comprising:

monitoring pressure along the high pressure lubricant line while injecting the hydraulic fracturing fluid through the one or more fluid control valves and down the wellbore.

* * * * *